United States Patent [19]

Gushea

[11] 4,447,982

[45] May 15, 1984

[54] BUBBLE-BLOWING APPARATUS

[76] Inventor: Roger B. Gushea, 142 Annetta St., Syracuse, N.Y. 13207

[21] Appl. No.: 401,669

[22] Filed: Jul. 26, 1982

[51] Int. Cl.[3] ..... A63H 33/28

[52] U.S. Cl. ..... 46/8

[58] Field of Search ..... 46/6–8; 40/407, 408

[56] References Cited

U.S. PATENT DOCUMENTS

| | | | |
|---|---|---|---|
| 2,412,732 | 12/1946 | Holman | 46/8 |
| 2,574,117 | 11/1951 | Ludwig | 46/8 |
| 2,675,641 | 4/1954 | Baggot | 46/8 |
| 2,912,790 | 11/1959 | Weber | 46/8 |
| 3,246,418 | 4/1966 | Anderson et al. | 46/8 |

*Primary Examiner*—F. Barry Shay

*Attorney, Agent, or Firm*—Charles S. McGuire

[57] ABSTRACT

A battery powered motor drives a fan blade to emit an air stream along a predetermined path and, through suitable speed reducing and motion transmission means, one or more members each carrying a dip ring at one end which is reciprocally moved between a first position wherein the ring is immersed in a liquid bubble forming material and a second position wherein the ring is in the path of the air stream, thus emitting a stream of bubbles. By providing two movable members the dip rings carried thereby may be of different sizes and arranged oppositely in their first and second positions to emit an essentially continuous stream of alternately large and small bubbles. The rings are preferably formed as open cylinders having a series of axially extending slits through the wall thereof. The fan blade is preferably of flexible material, bent to the proper pitch and reinforced with a string or thread stretched across the blade axis and secured to its ends.

3 Claims, 3 Drawing Figures

BUBBLE-BLOWING APPARATUS

BACKGROUND OF THE INVENTION

The present invention relates to novel apparatus for blowing "soap bubbles," and more specifically to such apparatus wherein a single motor drives both a fan to create a bubble-blowing air stream and one or more reciprocating members carrying dip rings for the bubble-forming liquid, as well as to novel structure of the dip rings and the fan propeller.

The prior art includes a number of forms of apparatus for blowing bubbles from a ring which is dipped into a liquid having suitable viscosity and surface tension properties, such as a soap solution. Such apparatus may include a fan driven by means such as a manually turned crank or an electric motor to create an air stream for blowing the bubbles. The sole purpose of the apparatus is normally the entertainment which children derive from watching a stream of bubbles emitted therefrom, although it may be incorporated in a toy object such as a gun (U.S. Pat. No. 2,974,438) or train (U.S. Pat. No. 2,675,641).

It is a principal object of the present invention to provide bubble-blowing apparatus having a unique mechanical movement which is both interesting and instructional for children to observe, in addition to automatically producing an essentially continuous stream of bubbles for entertainment.

A further object is to provide a novel form of apparatus wherein a single electric motor drives a fan to create an air stream and a dip ring which is reciprocally moved between positions wherein it is immersed in a bubble-forming liquid and in the path of the air stream.

Another object is to provide electrically driven bubble-blowing apparatus which is readily adaptable to being provided in kit form for assembly by the purchaser and having a unique mechanical construction and movement, whereby the assembly operation itself is an interesting and educational process.

Still another object is to provide a novel and improved construction of apparatus for dipping in a bubble-forming solution which will hold a greater amount of the solution, and thus have the capability of forming a greater quantity of bubbles with each immersion in the solution than prior art devices of this character.

A still further object is to provide a novel fan blade construction especially well-suited for employment in any devices such as the present invention, being highly flexible, yet reinforced to maintain the desired pitch.

Other objects will in part be obvious and will in part appear hereinafter.

SUMMARY OF THE INVENTION

In accordance with the foregoing objects, the bubble-blowing apparatus of the present invention includes a fractional horsepower electric motor, preferably for DC operation by batteries mounted on the apparatus, with a flexible fan blade on the motor output shaft. Rotation of the shaft is also transmitted and reduced in speed through one or more belts and pulleys to mechanism for converting the rotary motion to reciprocating arcuate or linear motion. One or more apertured members, termed "dip rings", are carried on the reciprocating member(s) for movement between lower and upper positions.

A container holding a quantity of conventional bubble-forming solution is positioned so that each ring is immersed in the solution when the reciprocating member by which it is carried is in its lower position. When the member is in its upper position, the ring is in the path of the air stream emitted by the fan to produce a stream of bubbles. In the preferred embodiments two reciprocating members are provided and arranged so that one is in its lower position when the other is in the upper position. In this way, the stream of bubbles is essentially continuous since one dip ring is raised into the air stream as the other is lowered.

The dip rings comprise cylindrical bodies with slots therethrough extending from the end opposite the source of the air stream for a portion of the length, thereby retaining a greater amount of bubble-forming liquid when dipped therein, and producing more bubbles when placed in the airstream. The fan blade is preferably made of highly flexible material such as thin plastic, rubber, or even paper, reinforced with a string or thread attached at its ends to hold the proper pitch or angle of attack, thus providing a good air stream while being harmless to small fingers which may come in contact with the blade during operation.

DETAILED DESCRIPTION

Figure 1:
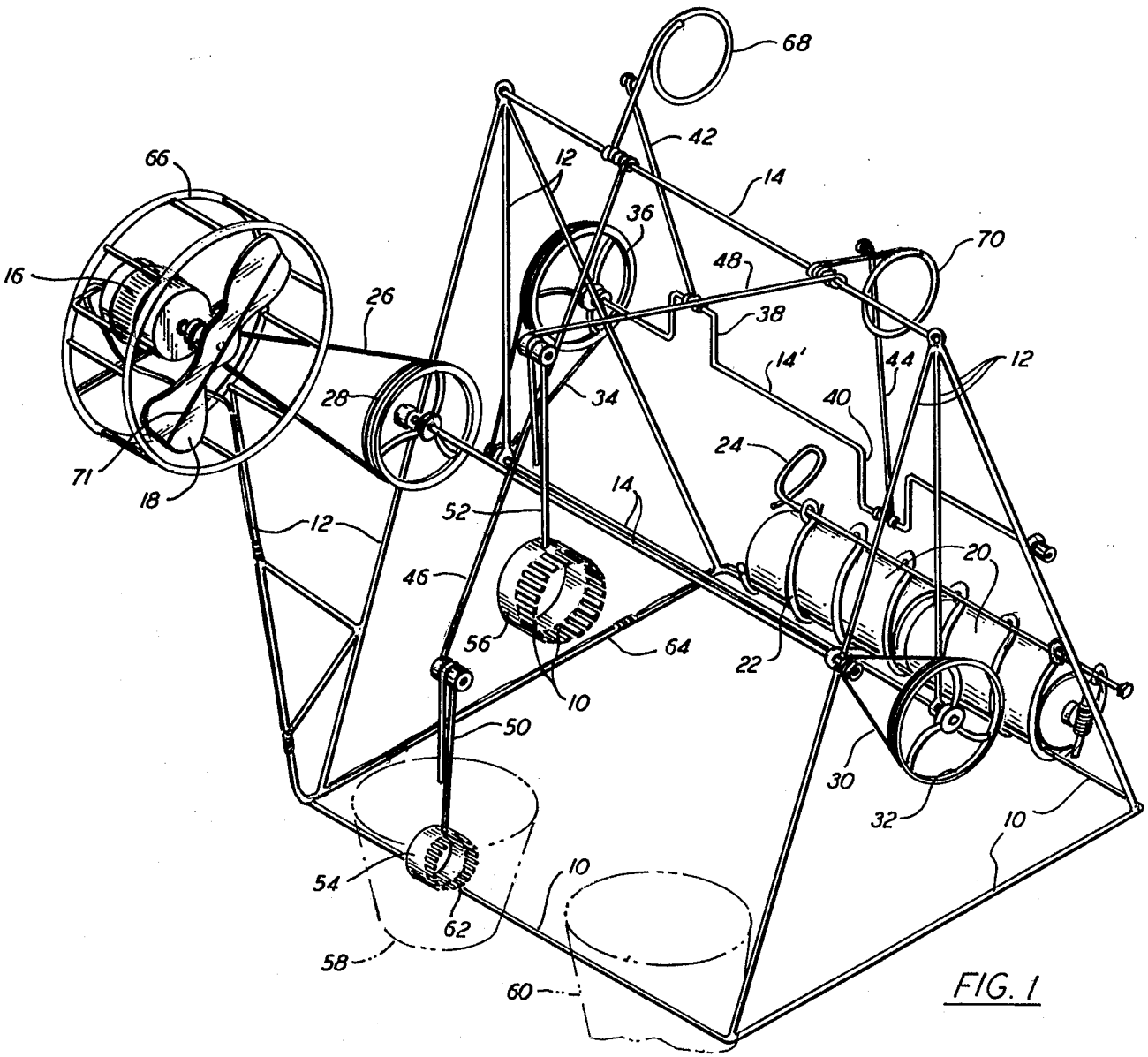
FIG. 1 is a perspective view of one embodiment of the bubble-blowing apparatus of the invention.
Figure 2:
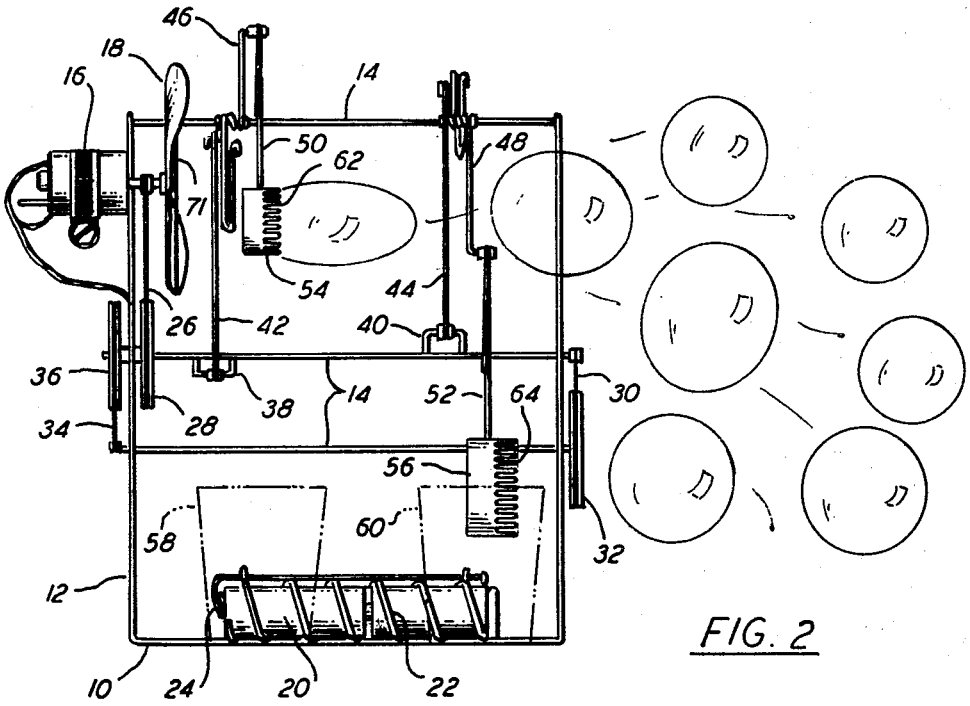
FIG. 2 is a front elevational view of the apparatus of FIG. 1.

The apparatus of the invention includes a framework which in the embodiment of FIGS. 1 and 2, is constructed of elongated, rigid rods of metal or plastic, including base members 10, upright members 12 and transverse members 14. Small DC electric motor 16 is mounted upon the framework and carries fan blade 18 on its output shaft. Motor 16 is connected by suitable leads (not shown) to batteries 20 which provide the required electrical power for operating the motor. Batteries 20 may be conveniently mounted in a spiral formed rod 22 mounted on the framework of the apparatus. An on/off switch is provided by metal rod 24 to which the electrical leads are connected and which is rotatable into and out of contact with one of the terminals of batteries 20 to complete or break the circuit between batteries 20 and motor 16.

Rotation of the output shaft of motor 16 is transmitted through belt 26, which may conveniently be in the form of a common rubber band, to pulley 28 which is affixed to an end of one of transverse members 14. Rotation is transmitted from the other end of this member 14, which is rotatably carried in suitable mountings on upright frame members 12, to belt 30 and thence to a second pulley 32 on another of transverse frame members 14. Belt 34 transmits rotation from the other end of this member to pulley 36 and thus to still another transverse member 14' which includes a pair of U-shaped bends 38 and 40 extending in opposite directions at spaced portions along its length, thereby forming a crankshaft.

Rigid links 42 and 44 are pivotally connected at one end of each to medial portions of bends 38 and 40, respectively, and at the other ends to arms 46 and 48. In this manner, rotation of member 14' is converted to reciprocating movement of arms 42 and 44 about pivoted mountings of each upon the uppermost of transverse frame members 14. Members 50 and 52 are pivotally suspended at their upper ends from reciprocating arms 46 and 48, respectively, and carry dip rings in the form of cylindrical members 54 and 56 on their lower ends. Thus, when motor 16 is operating, dip rings 54 and 56 are moved up and down between lower and upper positions in which members 54 and 56 are respectively shown in FIG. 1.

Suitable containers, such as cups 58 and 60, hold a supply of any conventional, bubble-forming liquid and are so positioned that dip rings 54 and 56 are fully immersed in the liquid when in their lower positions. When in their upper positions, rings 54 and 56 are positioned in the path of the air stream produced by rotation of fan blades 18. A plurality of slots 62 and 64 are cut through the cylindrical walls of dip rings 54 and 56 respectively extending axially from one end for a portion, e.g. one-half or more, of their length. When dip rings 54 and 56 are immersed in and removed from the liquid in containers 58 and 60, a film is formed which is converted into spherical bubbles by directing a stream of air through the rings. The additional liquid which is retained in slots 62 and 64 permit many more bubbles to be formed with each immersion of the rings in the liquid than would otherwise be possible. Slots 62 and 64 extend from the downstream end of the cylindrical walls of dip rings 54 and 56, with respect to the direction of the air stream.

Additional, optional features are shroud 66 surrounding motor 16 and fan blade 18, and loops 68 and 70 on arms 46 and 48 which serve as a conterbalance, making reciprocating movement of the arms easier and prolonging the life of batteries 20. Also, this string or thread 71 is preferably attached to the ends of fan blade 18 to provide rigidity for the blade, allowing its construction from paper or other extremely flexible materials for safety purposes while still maintaining a pitch or angle of attack which emits a high velocity air stream. String 71 perpendicularly intersects the rotational axis of fan blade 18 and further acts to prevent the blade from bending due to centrifugal forces to an extent which might interfere with belt and/or pulley operation. It also has the further desirable effect of tending to vary the blade pitch with differences in rotational speed, thereby providing a more constant air stream velocity over the life of the batteries with the fractional horsepower motor employed to drive the fan blade.

Figure 3:
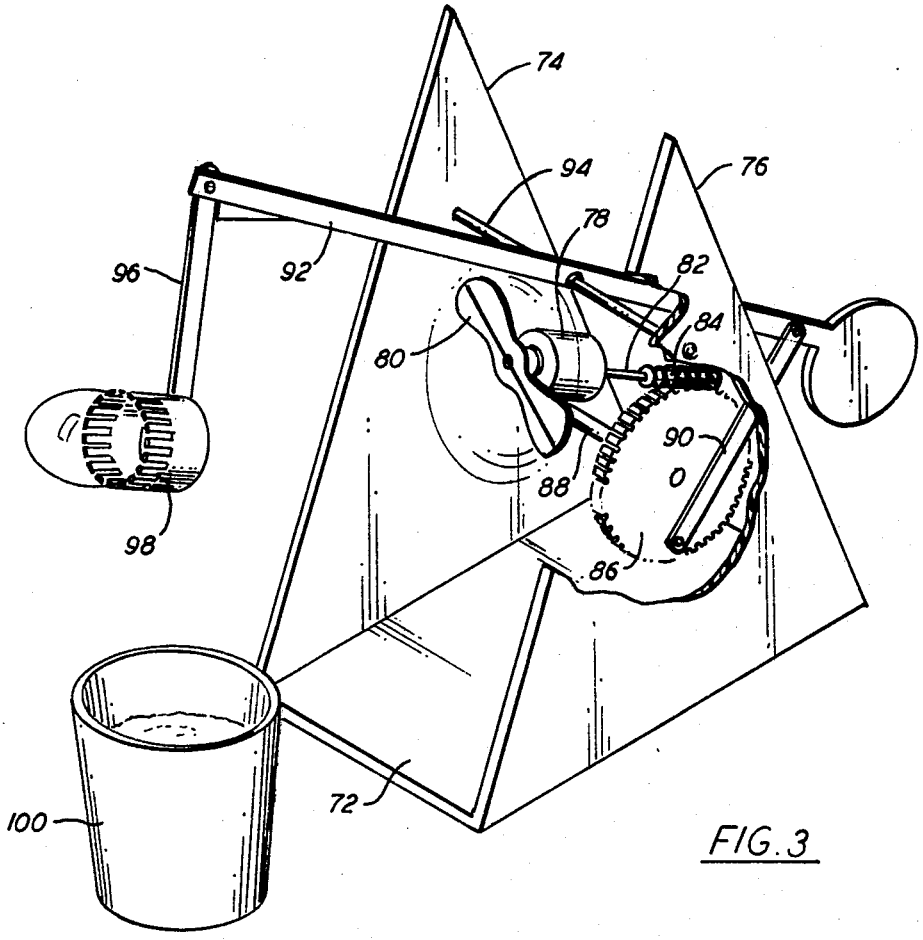
FIG. 3 is a perspective view of another embodiment.

The apparatus of the invention is subject to many modifications, one of which is shown in FIG. 3. The supporting framework is formed of a single sheet of material, e.g., transparent plastic, having base portion 72 and upstanding side portions 74 and 76. Motor 78 is supported by suitable structure connected to the framework and is operated as previously described by batteries, which are not shown in this embodiment. Flexible fan blade 80, having a reinforcing string attached in the same manner and for the same purposes as described with respect to string 71 in the previous embodiment, is rotated by a forwardly extending output shaft of motor 78 to emit an air stream along a predetermed path. Rearwardly extending output shaft 82 carries worm gear 84, and rotates at a speed much slower than the forward output shaft through reduction means provided by worm and gear size and drive angle.

Rotation of worm gear 84 is transmitted to gear 86, which is mounted on shaft 88, extending between upright portions 74 and 76 of the frame. Link 90 is pivotally attached at one end to the side of gear 86 and at the other to arm 92, which is carried on transverse shaft 94. Member 96 is suspended from the forward end of arm 92 and carries dip ring 98 on its lower end. Thus, as motor 78 rotates gears 84 and 86, link 90 produces reciprocating rotation of arm 92 about shaft 94, and up and down movement of dip ring 98 between a lower position, immersed in a bubble-forming liquid in container 100, and an upper position, in the path of the air stream emitted by fan blade 80. A stream of bubbles will be formed with each cycle of movement of dip ring 98.

What is claimed is:

1. Bubble-blowing apparatus comprising in combination:

(a) a fan blade rotatable to emit an air stream along a predetermined path;

(b) at least one dip ring adapted to carry a quantity of bubble-forming liquid when immersed therein and removed therefrom;

(c) an arm carrying said dip ring at a first point and mounted for movement about a first axis passing through said arm at a second point;

(d) means rotatable in one direction connected to said arm for imparting reciprocating movement to said arm about said axis to move said dip ring back and forth between a first position in said predetermined path and a second position below said first position; and (e) means including a single motor for imparting rotation to both said fan blade and said rotatable means;

(f) said fan blade being mounted upon, and rotated directly by, the output shaft of said motor, and said rotatable means including at least one belt and pulley connected for transferring rotation of said motor output shaft to additional rotating structure intermediate of said pulley and said arm.

2. The invention according to claim 1 wherein said rotatable means includes a member rotatable about a second axis, and a link connected at one end to said member at a point remote from said second axis for rotation thereabout, and at the other end to said arm at a third point thereon, said second point lying between said first and third points, whereby rotation of said one end of said link imparts said reciprocating movement to said arm.

3. The invention according to claim 1 and including at least two of said arms, each carrying one of said dip rings, and so moveable by said rotatable means that one of said arms is moving from its first to second position as another of said arms is moving from its second to first position.

* * * * *